US008072142B2

(12) United States Patent
Kawase et al.

(10) Patent No.: US 8,072,142 B2
(45) Date of Patent: Dec. 6, 2011

(54) PLASMA DISPLAY PANEL WITH IMPROVED LIGHT TRANSMITTANCE

(75) Inventors: Akira Kawase, Osaka (JP); Kazuhiro Morioka, Kyoto (JP); Tatsuo Mifune, Osaka (JP)

(73) Assignee: Panasonic Corporation, Osaka (JP)

( * ) Notice: Subject to any disclaimer, the term of this patent is extended or adjusted under 35 U.S.C. 154(b) by 811 days.

(21) Appl. No.: 11/993,181

(22) PCT Filed: Feb. 8, 2007

(86) PCT No.: PCT/JP2007/052261

§ 371 (c)(1),
(2), (4) Date: Dec. 19, 2007

(87) PCT Pub. No.: WO2007/094239

PCT Pub. Date: Aug. 23, 2007

(65) Prior Publication Data

US 2010/0219743 A1 Sep. 2, 2010

(30) Foreign Application Priority Data

Feb. 14, 2006 (JP) ..... 2006-036347

(51) Int. Cl.
*H01J 17/49* (2006.01)

(52) U.S. Cl. ..... 313/586; 313/582; 313/587

(58) Field of Classification Search ..... 313/582–587
See application file for complete search history.

(56) References Cited

U.S. PATENT DOCUMENTS 6,159,066 A 12/2000 Amatsu et al.
6,160,345 A 12/2000 Tanaka et al.
6,897,610 B1 5/2005 Aoki et al.
7,326,666 B2 2/2008 Yamamoto et al.
2002/0034917 A1 3/2002 Tanaka et al.
2002/0036466 A1 3/2002 Tanaka et al.
2003/0071572 A1 4/2003 Hibino et al.

(Continued)

FOREIGN PATENT DOCUMENTS

EP 1 816 667 8/2007

(Continued)

OTHER PUBLICATIONS

Supplementary European Search Report issued Oct. 1, 2008 in the Application No. EP 07 70 8245.

(Continued)

*Primary Examiner* — Toan Ton
*Assistant Examiner* — Fatima Farokhrooz
(74) *Attorney, Agent, or Firm* — Wenderoth, Lind & Ponack, L.L.P.

(57) ABSTRACT

A plasma display panel (PDP) with excellent display quality, including a dielectric layer that does not contain lead, satisfies transmittance, insulation resistance and dielectric constant, and suppresses coloring. The PDP includes front panel and a rear panel disposed facing each other and sealed together at the peripheries thereof with discharge space provided therebetween. The front panel includes display electrodes, a dielectric layer and a protective layer on a front glass substrate. The rear panel includes electrodes, barrier ribs and phosphor layers on a substrate. In the PDP, the display electrode includes metal bus electrodes containing silver. The dielectric layer includes a first dielectric layer covering metal bus electrodes and containing bismuth oxide, and a second dielectric layer covering the first dielectric layer and containing bismuth oxide. The thickness ratio of the second dielectric layer to the first dielectric layer is 1.3 or more and 7.2 or less.

8 Claims, 2 Drawing Sheets

U.S. PATENT DOCUMENTS

| | | | | |
|---|---|---|---|---|
| 2004/0232840 | A1 | 11/2004 | Aoki et al. | |
| 2005/0007308 | A1* | 1/2005 | Suzuki et al. | 345/60 |
| 2005/0011228 | A1* | 1/2005 | Hayashi et al. | 65/32.1 |
| 2005/0242725 | A1 | 11/2005 | Hasegawa et al. | |
| 2006/0019814 | A1* | 1/2006 | Baik et al. | 501/49 |
| 2007/0052361 | A1 | 3/2007 | Hasegawa et al. | |
| 2008/0116803 | A1 | 5/2008 | Kawase et al. | |
| 2008/0164815 | A1 | 7/2008 | Kawase et al. | |

FOREIGN PATENT DOCUMENTS

| | | |
|---|---|---|
| EP | 1 933 352 | 6/2008 |
| FR | 2 805 393 | 8/2001 |
| JP | 9-50769 | 2/1997 |
| JP | 2001-195989 | 7/2001 |
| JP | 2001-266753 | 9/2001 |
| JP | 2002-25341 | 1/2002 |
| JP | 2002-53342 | 2/2002 |
| JP | 2003-115261 | 4/2003 |
| JP | 2003-128430 | 5/2003 |
| JP | 2003-162962 | 6/2003 |
| JP | 2 003-192376 | 7/2003 |
| JP | 2004-327456 | 11/2004 |
| JP | 2004-345913 | 12/2004 |
| JP | 2005-38824 | 2/2005 |
| JP | 2005-41734 | 2/2005 |
| JP | 2005-231923 | 9/2005 |
| JP | 2005320227 | * 11/2005 |
| KR | 10-2005-0043711 | 5/2005 |
| KR | 10-2005-0077391 | 8/2005 |
| WO | 2006/107051 | 10/2006 |

OTHER PUBLICATIONS

International Search Report issued Apr. 24, 2007 in the International (PCT) Application No. PCT/JP2007/052261.

* cited by examiner

PLASMA DISPLAY PANEL WITH IMPROVED LIGHT TRANSMITTANCE

This Application is a U.S. National Phase Application of PCT International Application PCT/JP2007/052261.

TECHNICAL FIELD

The present invention relates to a plasma display panel used in a display device, and the like.

BACKGROUND ART

Since a plasma display panel (hereinafter, referred to as "PDP") can realize both high definition and a large screen, 65-inch class televisions have been commercialized. Recently, PDPs have been applied to full high-definition in which the number of scan lines is twice or more than that of a conventional NTSC method. Meanwhile, from the viewpoint of environmental problems, PDPs which do not contain lead have been demanded.

A PDP basically includes a front panel and a rear panel. The front panel includes a glass substrate of sodium borosilicate glass produced by a float process; display electrodes each composed of striped transparent electrode and metal bus electrode formed on one principal surface of the glass substrate; a dielectric layer covering the display electrodes and functioning as a capacitor; and a protective layer made of magnesium oxide (MgO) formed on this dielectric layer. On the other hand, the rear panel includes a glass substrate; striped address electrodes formed on one principal surface of the glass substrate; a base dielectric layer covering the address electrodes; barrier ribs formed on the base dielectric layer; and phosphor layers formed between the barrier ribs and emitting red, green and blue light, respectively.

The front panel and the rear panel are hermetically sealed and arranged so that their surfaces having electrodes face each other. Discharge gas of Ne—Xe is filled in a discharge space participated by the barrier ribs at a pressure of 400 Torr to 600 Torr. The PDP realizes a color image display by selectively applying a video signal voltage to a display electrode so as to generate electric discharge, and exciting a phosphor layer of each color with an ultraviolet ray generated by the electric discharge so as to emit red, green and blue light.

For the metal bus electrode of the display electrode, a silver electrode for securing electric conductivity is used, and for the dielectric layer, a low melting point glass material containing lead oxide as a main component is used. Recently, however, from the viewpoint of environmental problems, examples in which a dielectric layer does not contain a lead component have been disclosed (see, for example, patent documents 1, 2 and 3).

As previously mentioned, PDPs have been applied to full high-definition in which the number of scan lines is twice or more than that of a conventional NTSC method. With such a trend toward high definition, the number of scan lines is increased, and the number of display electrodes is increased. Furthermore, the interval between the display electrodes is reduced.

Therefore, diffusion of silver ions from a silver electrode constituting a display electrode to a dielectric layer is increased. When silver ions diffuse to the dielectric layer, they are subjected to a reduction reaction with alkali metal ions in the dielectric layer. Thus, silver oxide colloid is formed. Then, this silver oxide allows the dielectric layer to be strongly colored yellow or brown. At the same time, a part of the silver oxide is subjected to a reduction reaction so as to generate oxygen bubbles, and the bubbles cause insufficient insulation.

Then, it is proposed that a low melting point glass material such as bismuth oxide, which suppresses the reaction with a silver electrode, be used for a dielectric layer instead of using a lead component. However, when a large amount of low melting point glass materials such as bismuth oxide is used for a dielectric layer, the visible light transmittance of the dielectric layer is remarkably lowered. When the amount of the low melting point glass material such as bismuth oxide is reduced in order to suppress the lowering of the visible light transmittance of the dielectric layer, the reaction with silver electrode cannot be suppressed sufficiently, which may cause coloring and insufficient insulation.

Thus, a conventional dielectric layer which does not contain a lead component, which has been proposed from the viewpoint of environmental problems, has had a problem that it is difficult to achieve both the prevention of coloring and insufficient insulation and the suppression of lowering of the visible light transmittance in the dielectric layer.

[Patent document 1] Japanese Patent Unexamined Publication No. 2003-128430

[Patent document 2] Japanese Patent Unexamined Publication No. 2002-053342

[Patent document 3] Japanese Patent Unexamined Publication No. H9-050769

SUMMARY OF THE INVENTION

The present invention addresses the problems discussed above, and aims to provide a PDP including a dielectric layer that does not contain a lead component, in which coloring and insufficient insulation of the dielectric layer are prevented and lowering of the visible light transmittance is suppressed even in a high definition display.

The PDP of the present invention includes a front panel and a rear panel disposed facing each other and sealed together at the peripheries thereof with discharge space being provided therebetween. The front panel includes display electrodes, a dielectric layer and a protective layer formed on a glass substrate; and the rear panel includes electrodes, barrier ribs, and phosphor layers formed on a substrate. In particular, the display electrode contains at last silver. The dielectric layer includes a first dielectric layer covering the display electrodes and containing bismuth oxide, and a second dielectric layer covering the first dielectric layer and containing bismuth oxide. The thickness ratio of the second dielectric layer to the first dielectric layer is set to be not less than 1.3 and not more than 7.2.

Furthermore, the dielectric layer of the PDP of the present invention includes a first dielectric layer covering the display electrodes, and a second dielectric layer covering the first dielectric layer and having a lower content of bismuth oxide than that of the first dielectric layer.

When the dielectric layer includes the first dielectric layer having a higher content of bismuth oxide in order to suppress the reaction with silver, and the second dielectric layer having a lower content of bismuth oxide in order to avoid the lowering of the visible light transmittance in the thickness ratio mentioned above, the first dielectric layer suppresses the reaction with silver and the second dielectric layer secures a necessary withstand voltage without lowering the visible light transmittance. As a result, even in a high definition display, it is possible to realize a PDP including a dielectric layer, in which coloring and insufficient insulation of the dielectric layer are prevented and lowering of the visible light transmittance is suppressed.

Furthermore, it is desirable that the first dielectric layer includes not less than 0.1 wt % and not more than 7 wt % of at least one of molybdenum oxide and tungsten oxide. Thus, molybdenum oxide and tungsten oxide are reacted with silver ions, so that it is possible to suppress the generation of silver colloid and bubbles.

Furthermore, it is desirable that the second dielectric layer includes not less than 11 wt % and not more than 20 wt % of bismuth oxide. Thus, the visible light transmittance can be enhanced.

Furthermore, it is desirable that the first dielectric layer and the second dielectric layer include at least one of zinc oxide, boron oxide, silicon oxide, aluminum oxide, calcium oxide, strontium oxide, and barium oxide. Thus, it is possible to realize a PDP which includes a dielectric layer that is not deteriorated in withstand voltage performance and has high visible light transmittance and which is environmentally friendly and excellent in display quality.

As mentioned above, according to the present invention, it is possible to realize a PDP including a dielectric layer that does not contain a lead component, in which coloring and insufficient insulation of the dielectric layer are prevented and the lowering of the visible light transmittance is suppressed even in a high definition display.

REFERENCE MARKS IN THE DRAWINGS

Figure 1:
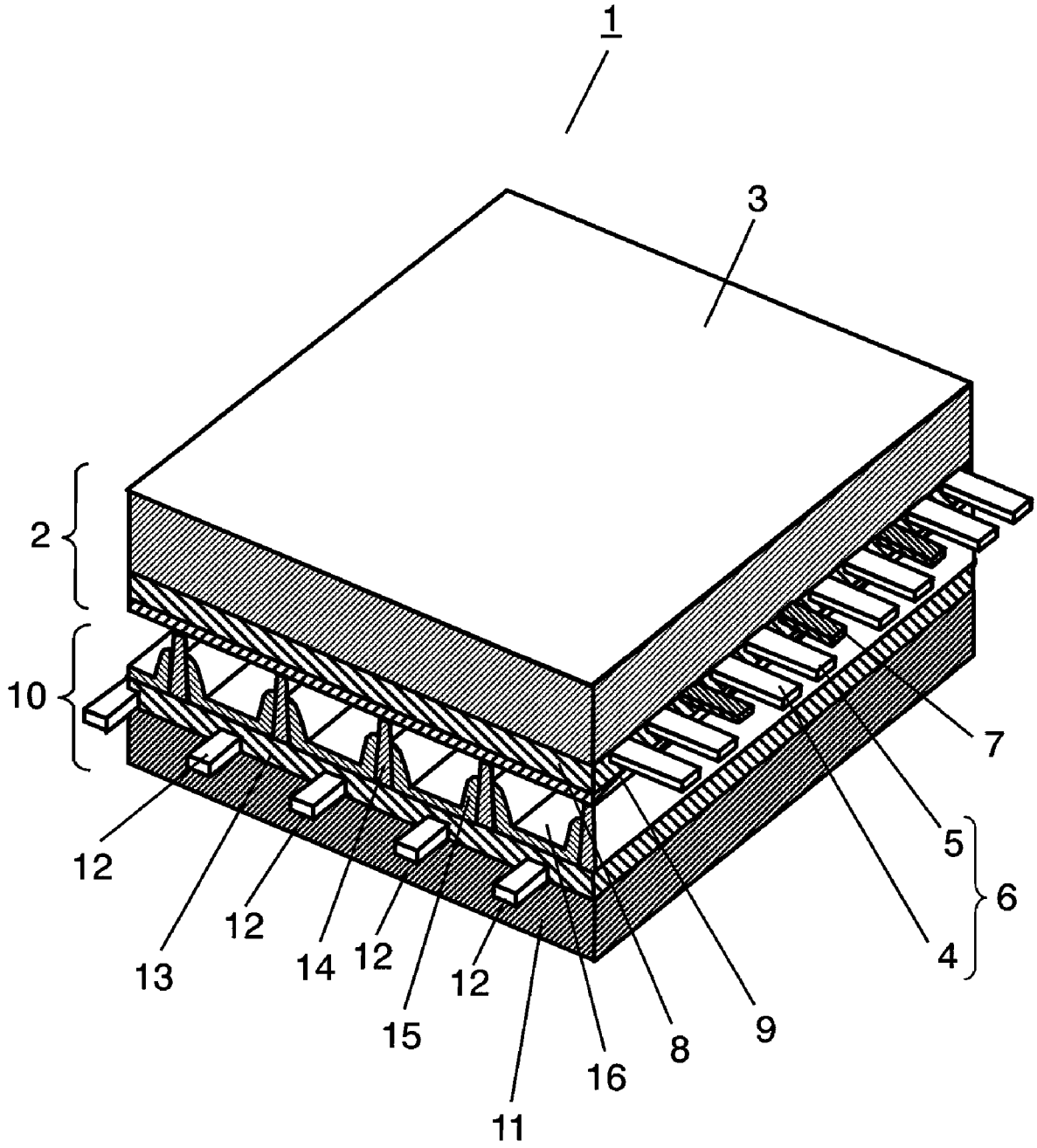
FIG. 1 is a perspective view showing a structure of a PDP in accordance with an exemplary embodiment of the present invention.

1 PDP
2 front panel
3 front glass substrate
4 scan electrode
4*a*, 5*a* transparent electrode
4*b*, 5*b* metal bus electrode
5 sustain electrode
6 display electrode
7 black stripe (light blocking layer)
8 dielectric layer
9 protective layer
10 rear panel
11 rear glass substrate
12 address electrode
13 base dielectric layer
14 barrier rib
15 phosphor layer
16 discharge space
81 first dielectric layer
82 second dielectric layer

DETAILED DESCRIPTION OF THE INVENTION

Hereinafter, a PDP in accordance with an exemplary embodiment of the present invention is described with reference to drawings.

Exemplary Embodiment

FIG. 1 is a perspective view showing a structure of a PDP in accordance with an exemplary embodiment of the present invention. The basic structure of the PDP is the same as that of a general AC surface discharge PDP. As shown in FIG. 1, PDP 1 includes front panel 2 and rear panel 10 disposed facing each other and hermetically sealed together at the peripheries thereof with a sealing material including a glass frit, and the like. Front panel 2 includes front glass substrate 3, etc., and rear panel 10 includes rear glass substrate 11, etc. In discharge space 16 inside the sealed PDP 1, discharge gas such as neon (Ne) and xenon (Xe) is filled in at a pressure of 400 Torr to 600 Torr.

On front glass substrate 3 of front panel 2, a plurality of band-like display electrodes 6 each composed of a pair of scan electrode 4 and sustain electrode 5 and black stripes (light blocking layers) 7 are disposed in parallel to each other. On glass substrate 3, dielectric layer 8 functioning as a capacitor is formed so as to cover display electrodes 6 and black stripes (light blocking layers) 7. Furthermore, on the surface of dielectric layer 8, protective layer 9 made of, for example, magnesium oxide (MgO) is formed.

Furthermore, on rear glass substrate 11 of rear panel 10, a plurality of band-like address electrodes 12 are disposed in parallel to each other in the direction perpendicular to scan electrodes 4 and sustain electrodes 5 of front panel 2, and address electrodes 12 are covered with based dielectric layer 13. In addition, between address electrodes 12 on dielectric layer 13, a plurality of barrier ribs 14 with a predetermined height for partitioning discharge space 16 are formed. In grooves between barrier ribs 14, every address electrode 12, phosphor layers 15 emitting red, blue and green light by ultraviolet ray are sequentially formed by coating. In positions in which scan electrodes 4, sustain electrodes 5 and address electrodes 12 intersect each other, discharge cells are formed. The discharge cells having red, blue and green phosphor layers 15 arranged in the direction of display electrode 6 function as pixel for color display.

Figure 2:
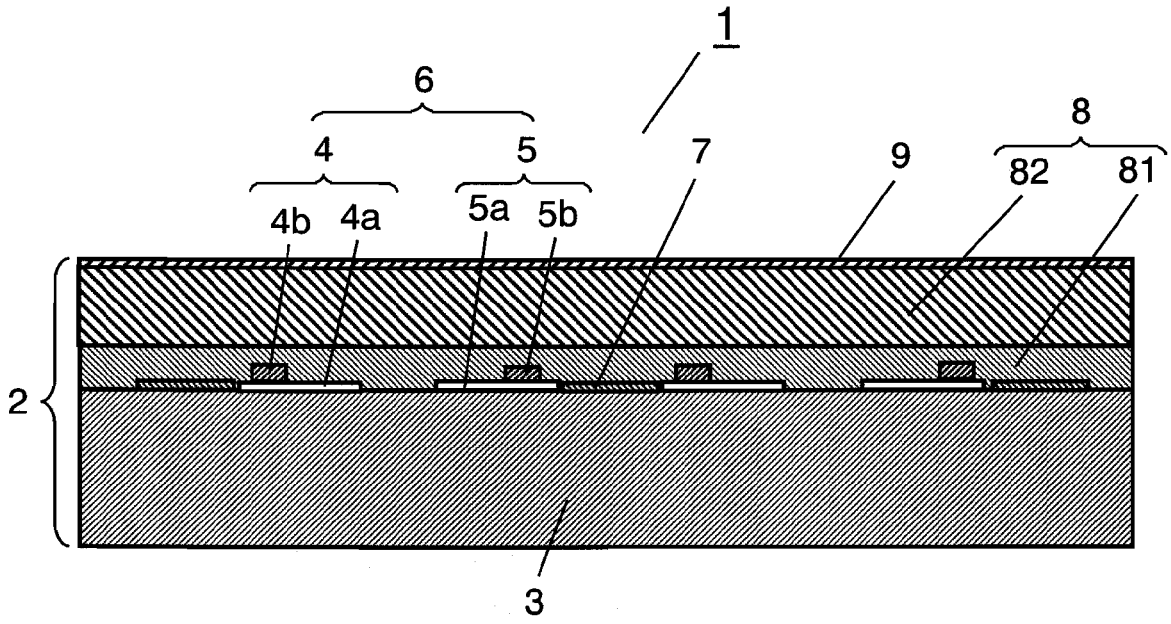
FIG. 2 is a sectional view of a front panel, showing a configuration of a dielectric layer of the PDP in accordance with an exemplary embodiment of the present invention.

FIG. 2 is a sectional view of front panel 2 showing a configuration of dielectric layer 8 of the PDP in accordance with an exemplary embodiment of the present invention. FIG. 2 is shown turned upside down with respect to FIG. 1. As shown in FIG. 2, on front glass substrate 3 produced by, for example, a float method, display electrodes 6 each composed of scan electrode 4 and sustain electrode 5 and black stripes (light blocking layers) 7 are formed by patterning. Scan electrode 4 and sustain electrode 5 include transparent electrodes 4*a* and 5*a* made of indium tin oxide (ITO), tin oxide ($SnO_2$), or the like, and metal bus electrodes 4*b* and 5*b* formed on transparent electrodes 4*a* and 5*a*, respectively. Metal bus electrodes 4*b* and 5*b* are used for the purpose of providing conductivity in the longitudinal direction of transparent electrodes 4*a* and 5*a* and formed of a conductive material containing a silver material as a main component.

Dielectric layer 8 includes at least two layers, that is, first dielectric layer 81 and second dielectric layer 82. First dielectric layer 81 is provided for covering transparent electrodes 4*a* and 5*a*, metal bus electrodes 4*b* and 5*b*, and black stripes (light blocking layers) 7 formed on front glass substrate 3. Second dielectric layer 82 is formed on first dielectric layer 81. Furthermore, on second dielectric layer 82, protective layer 9 is formed.

Next, a method of manufacturing a PDP is described. Firstly, scan electrodes 4, sustain electrodes 5 and black stripes (light blocking layers) 7 are formed on front glass substrate 3. Transparent electrodes 4*a* and 5*a* and metal bus electrodes 4*b* and 5*b* are formed by patterning by using, for example, a photolithography method. Transparent electrodes 4*a* and 5*a* are formed by, for example, a thin film process. Metal bus electrodes 4*b* and 5*b* are formed by firing paste including a silver material at a predetermined temperature and solidifying it. Furthermore, black stripe (light blocking layer) 7 is similarly formed by a method of screen printing of paste including a black pigment, or a method of forming a black pigment over the entire surface of the glass substrate, then carrying out patterning by a photolithography method, and firing thereof.

Next, a dielectric paste is coated on front glass substrate 3 by, for example, a die coating method so as to cover scan electrodes 4, sustain electrodes 5 and black stripes (light blocking layers) 7, thus forming a dielectric paste layer (dielectric material layer). After dielectric paste is coated, it is stood still for a predetermined time. Thus, the surface of the coated dielectric paste is leveled and flattened. Thereafter, by firing and solidifying the dielectric paste layer, dielectric layer 8 covering scan electrodes 4, sustain electrodes 5 and black stripes (light blocking layers) 7 is formed. Note here that the dielectric paste is a coating material including a dielectric material such as glass powder, a binder and a solvent. Next, on dielectric layer 8, protective layer 9 made of magnesium oxide (MgO) is formed by a vacuum evaporation method. With the above-mentioned process, on front glass substrate 3, predetermined components, for example, scan electrodes 4, sustain electrodes 5, black stripes (light blocking layers) 7, dielectric layer 8 and protective layer 9 are formed. Thus, front panel 2 is completed.

On the other hand, rear panel 10 is formed as follows. Firstly, a material layer as components for address electrode 12 is formed on rear glass substrate 11 by a method of screen printing a paste including a silver material, or by a method of forming a metal film on the entire surface, followed by patterning by using a photolithography method. The material layer is fired at a predetermined temperature. Thus, address electrode 12 is formed.

Next, a dielectric paste is coated by a die coating method on rear glass substrate 11 on which address electrodes 12 are formed so as to cover address electrodes. Thus, a dielectric paste layer is formed. Thereafter, by firing the dielectric paste layer, base dielectric layer 13 is formed. Note here that a dielectric paste is a coating material including a dielectric material such as glass powder, a binder and a solvent.

Next, by coating a barrier rib formation paste including materials for barrier ribs on base dielectric layer 13 and patterning it into a predetermined shape, a barrier rib material layer is formed, and then fired. Thus, barrier ribs 14 are formed. Herein, a method of patterning the barrier rib formation paste coated on base dielectric layer 13 may include a photolithography method and a sand blasting method.

Next, phosphor layer 15 is formed by coating a phosphor paste including phosphor materials between neighboring barrier ribs 14 on base dielectric layer 13 and on the side surface of barrier rib 14 and firing thereof. With the above-mentioned process, rear panel 10 having predetermined component members is completed on rear glass substrate 11.

Front panel 2 and rear panel 10, which are provided with predetermined component members, are disposed facing each other such that scan electrodes 4 and address electrodes 12 are disposed orthogonal to each other and sealed together at the peripheries thereof with a glass frit. Discharge gas including neon, xenon, or the like, is filled in the discharge space. Thus, PDP 1 is formed.

First dielectric layer 81 and second dielectric layer 82 constituting dielectric layer 8 of front panel 2 are described. A dielectric material of first dielectric layer 81 includes the following material composition. The material composition includes 25 wt % to 40 wt % of bismuth oxide ($Bi_2O_3$), 27.5 wt % to 34 wt % of zinc oxide (ZnO), 17 wt % to 36 wt % of boron oxide ($B_2O_3$), 1.4 wt % to 4.2 wt % of silicon oxide ($SiO_2$) and 0.5 wt % to 4.4 wt % of aluminum oxide ($Al_2O_3$). Furthermore, 5 wt % to 13 wt % of at least one selected from calcium oxide (CaO), strontium oxide (SrO) and barium oxide (BaO) and 0.1 wt % to 7 wt % of at least one selected from molybdenum oxide ($MoO_3$) and tungsten oxide ($WO_3$) are included.

Instead of molybdenum oxide ($MoO_3$) and tungsten oxide ($WO_3$), 0.1 wt % to 7 wt % of at least one selected from cerium oxide ($CeO_2$), copper oxide (CuO), manganese dioxide ($MnO_2$), chromium oxide ($Cr_2O_3$), cobalt oxide ($CO_2O_3$), vanadium oxide ($V_2O_7$) and antimony oxide ($Sb_2O_3$) may be included.

The dielectric materials including these composition components are ground to have an average particle diameter of 0.5 μm to 2.5 μm by using a wet jet mill or a ball mill. Thus, dielectric material powder is formed. Then, 55 wt % to 70 wt % of this dielectric material powder and 30 wt % to 45 wt % of binder components are well kneaded by using three rolls to form a paste for the first dielectric layer to be used in die coating or printing. The binder component includes ethyl cellulose, or terpineol including 1 wt % to 20 wt % of acrylic resin, or butyl carbitol acetate. Furthermore, in the paste, if necessary, dioctyl phthalate, dibutyl phthalate, triphenyl phosphate, and tributyl phosphate may be added as a plasticizer, and glycerol monooleate, sorbitan sesquioleate, Homogenol (trademark of Kao Corporation), phosphate ester of an alkyl-allyl group, and the like, may be added as a dispersing agent, so that the printing property may be improved.

Then, this paste for the first dielectric layer is printed on front glass substrate 3 by a die coating method or a screen printing method so as to cover display electrode 6 and then dried, followed by firing it at a temperature of 575° C. to 590° C., that is, a little higher temperature than the softening temperature of the dielectric material.

Next, second dielectric layer 82 is described. A dielectric material of second dielectric layer 82 includes the following material composition. The material composition includes 11 wt % to 20 wt % of bismuth oxide ($Bi_2O_3$), 26.1 wt % to 39.3 wt % of zinc oxide (ZnO), 23 wt % to 32.2 wt % of boron oxide ($B_2O_3$), 1.0 wt % to 3.8 wt % of silicon oxide ($SiO_2$) and 0.1 wt % to 10.2 wt % of aluminum oxide ($Al_2O_3$). Furthermore, 9.7 wt % to 29.4 wt % of at least one selected from calcium oxide (CaO), strontium oxide (SrO) and barium oxide (BaO), and 0.1 wt % to 5 wt % of cerium oxide ($CeO_2$) are included.

The dielectric materials including these composition components are ground to have an average particle diameter of 0.5 μm to 2.5 μm by using a wet jet mill or a ball mill. Thus, dielectric material powder is formed. Then, 55 wt % to 70 wt % of this dielectric material powder and 30 wt % to 45 wt % of binder components are well kneaded by using three rolls to form a paste for the second dielectric layer to be used in die coating or printing. The binder component includes ethyl cellulose, or terpineol including 1 wt % to 20 wt % of acrylic resin, or butyl carbitol acetate. Furthermore, in the paste, if necessary, dioctyl phthalate, dibutyl phthalate, triphenyl phosphate, and tributyl phosphate may be added as a plasticizer, and glycerol monooleate, sorbitan sesquioleate, Homogenol (trademark of Kao Corporation), phosphate ester of an alkyl-allyl group, and the like, may be added as a dispersing agent, so that the printing property may be improved.

Then, this paste for the second dielectric layer is printed on first dielectric layer 81 by a screen printing method or a die coating method and then dried, followed by firing it at a temperature of 550° C. to 590° C., that is, a little higher temperature than the softening temperature of the dielectric material.

Herein, it is preferable that the film thickness of dielectric layer 8 is not more than 41 μm in total of first dielectric layer 81 and second dielectric layer 82 in order to secure the visible light transmittance. The content of bismuth oxide in first dielectric layer 81 is set to be 25 wt % to 40 wt %, which is higher than the content of bismuth oxide in second dielectric layer 82, in order to suppress the reaction between metal bus electrodes 4*b* and 5*b* and silver (Ag). Therefore, since the visible light transmittance of first dielectric layer 81 becomes lower than that of second dielectric layer 82, the film thickness of first dielectric layer 81 is set to be thinner than that of second dielectric layer 82.

It is not preferable that, the content of bismuth oxide ($Bi_2O_3$) is not more than 11 wt % in second dielectric layer 82 because the visible light transmittance is not easily lowered but bubbles tend to be generated in second dielectric layer 82. Furthermore, it is not preferable that the content is more than 20 wt % for the purpose of increasing the visible light transmittance.

As the film thickness of dielectric layer 8 is smaller, the effect of improving the panel brightness and reducing the discharge voltage can be achieved remarkably. However, if the film thickness of dielectric layer 8 is made to be too small, necessary withstand voltage cannot be obtained.

Thus, in order to suppress the reaction between metal bus electrodes 4*b* and 5*b* and silver, it is necessary that first dielectric layer 81 covering metal bus electrodes 4*b* and 5*b* have a high content of bismuth oxide. Furthermore, in order to obtain the withstand voltage, dielectric layer 8 needs a predetermined film thickness. Therefore, second dielectric layer 82, which does not extremely reduce the visible light transmittance, has a low content of bismuth oxide and has a predetermined film thickness, is necessary.

Then, the film thicknesses of first dielectric layer 81 and second dielectric layer 82 satisfying the above-mentioned conditions are examined. As a result, it is found that the thickness ratio of second dielectric layer 82 to first dielectric layer 81 is not less than 1.3 and not more than 7.2. This is because when the thickness ratio is less than 1.3, necessary withstand voltage cannot be obtained, and when it is more than 7.2, the visible light transmittance is remarkably lowered.

Next, in the PDP in accordance with the exemplary embodiment of the present invention, the reason why these dielectric materials suppress the coloring and generation of bubbles in first dielectric layer 81 is considered. That is to say, by adding molybdenum oxide ($MoO_3$) or tungsten oxide ($WO_3$) to a dielectric glass material containing bismuth oxide ($Bi_2O_3$), it is known that compounds such as $Ag_2MoO_4$, $Ag_2Mo_2O_7$, $Ag_2Mo_4O_{13}$, $Ag_2WO_4$, $Ag_2W_2O_7$, and $Ag_2W_4O_{13}$ are easily generated at a low temperature such as not more than 580° C.

In the exemplary embodiment of the present invention, since the firing temperature of dielectric layer 8 is in the range from 550° C. to 590° C., Ag ions ($Ag^+$) diffusing in dielectric layer 8 during firing react with molybdenum oxide ($MoO_3$) and tungsten oxide ($WO_3$) in dielectric layer 8, so that a stable compound is generated and stabilized. That is to say, since Ag ions ($Ag^+$) are not subjected to reduction reaction but stabilized, the ions do not coagulate and a colloid is not formed. Therefore, by the stabilization of Ag ions ($Ag^+$), since generation of oxygen associated with formation of silver (Ag) colloid is decreased. Consequently, the generation of bubbles in dielectric layer 8 is also decreased.

On the other hand, in order to obtain such advantages effectively, it is preferable that the content of molybdenum oxide ($MoO_3$) or tungsten oxide ($WO_3$) in the dielectric glass material containing bismuth oxide ($Bi_2O_3$) is made to be not less than 0.1 wt %. It is further preferable that the content is made to be not less than 0.1 wt % and not more than 7 wt %. In particular, it is not preferable that the content is not more than 0.1 wt % because the effect of suppressing coloring is reduced; and it is not preferable that the content is more than 7 wt % because coloring occurs in a dielectric glass material.

That is to say, in dielectric layer 8 of the PDP in accordance with the exemplary embodiment of the present invention, first dielectric layer 81 that is brought into contact with metal bus electrode 4*b* and 5*b* made of a silver material suppresses the phenomenon of coloring and generation of bubbles, and second dielectric layer 82 formed on the first dielectric layer 81 realizes high visible light transmittance while securing the withstand voltage. As a result, as entire dielectric layer 8, generation of bubbles and coloring is extremely reduced and visible light transmittance is high. Thus, a PDP including such dielectric layer 8 can be realized.

INDUSTRIAL APPLICABILITY

A PDP of the present invention includes a dielectric layer that is free from coloring or deterioration of the withstand voltage performance, and is environmentally friendly and excellent in display quality. The PDP of the present invention is useful for a large-screen display device.

The invention claimed is:

1. A plasma display panel comprising:

a front panel including display electrodes, a dielectric layer and a protective layer formed on a front glass substrate; and a rear panel including electrodes, barrier ribs, and phosphor layers formed on a rear substrate, wherein the first panel and the rear panel are disposed facing each other and sealed together at peripheries thereof with discharge space provided therebetween, wherein the display electrodes contain at least silver, wherein the dielectric layer includes a first dielectric layer and a second dielectric layer, the first dielectric layer covering the display electrodes and containing bismuth oxide, and the second dielectric layer covering the first dielectric layer and containing bismuth oxide, wherein a thickness ratio of the second dielectric layer to the first dielectric layer is not less than 1.3 and not more than 7.2, and wherein the first dielectric layer includes not less than 0.1 wt % and not more than 7 wt % of at least one of molybdenum oxide and tungsten oxide.

2. The plasma display panel of claim 1, wherein the second dielectric layer has a lower content of bismuth oxide than that of the first dielectric layer.

3. The plasma display panel of claim 1, wherein the second dielectric layer includes not less than 11 wt % and not more than 20 wt % of bismuth oxide.

4. The plasma display panel of claim 1, wherein the first dielectric layer and the second dielectric layer include at least one of zinc oxide, boron oxide, silicon oxide, aluminum oxide, calcium oxide, strontium oxide, and barium oxide.

5. The plasma display panel of claim 1, wherein the first dielectric layer includes not less than 0.1 wt % and not more than 7 wt % of molybdenum oxide.

6. The plasma display panel of claim 1, wherein the first dielectric layer includes not less than 0.1 wt % and not more than 7 wt % of tungsten oxide.

7. The plasma display panel of claim 2, wherein the first dielectric layer and the second dielectric layer include at least one of zinc oxide, boron oxide, silicon oxide, aluminum oxide, calcium oxide, strontium oxide, and barium oxide.

8. The plasma display panel of claim 2, wherein the second dielectric layer includes not less than 11 wt % and not more than 20 wt % of bismuth oxide.

* * * * *